United States Patent [19]

Cowan et al.

[11] Patent Number: 4,746,246

[45] Date of Patent: May 24, 1988

[54] REMOTELY ACTUATED CUTTING ASSEMBLY FOR BROKEN UNDERWATER GUIDELINES

[75] Inventors: William S. Cowan; Douglas D. Hall, both of Houston, Tex.

[73] Assignee: National-Oilwell, Houston, Tex.

[21] Appl. No.: 311,261

[22] Filed: Oct. 14, 1981

[51] Int. Cl.[4] ..... E21B 7/12

[52] U.S. Cl. ..... 405/191; 166/339; 166/349; 166/54.5

[58] Field of Search ..... 405/191, 195; 144/34 E; 30/90.1, 228; 83/600, 639, 380, 390; 166/339, 349, 340, 54.5

[56] References Cited

U.S. PATENT DOCUMENTS

| | | | |
|---|---|---|---|
| 488,847 | 12/1892 | Squires et al. . | |
| 504,203 | 8/1893 | De Bem . | |
| 541,018 | 6/1895 | Shryock . | |
| 756,730 | 4/1904 | Wolf . | |
| 1,042,630 | 10/1912 | Wetmore . | |
| 2,175,757 | 10/1939 | Metzler | 43/30 |
| 2,825,536 | 3/1958 | Kenneday et al. | 255/34 |
| 2,919,111 | 12/1959 | Nicolson | 83/639 X |
| 2,930,122 | 3/1960 | Pfundt | 30/228 |
| 2,934,822 | 5/1960 | Docken | 30/228 X |
| 3,036,522 | 5/1962 | Lindsey | 102/20 |
| 3,294,131 | 12/1966 | Larson | 83/600 X |
| 3,367,299 | 2/1968 | Sayre, Jr. | 405/191 X |
| 3,381,485 | 5/1968 | Crooks et al. | 405/191 |
| 3,709,291 | 1/1973 | Hanes et al. | 166/54.5 |
| 3,739,673 | 6/1973 | Temple | 83/639 |
| 3,926,252 | 12/1975 | Ribeyre et al. | 166/54.6 |
| 3,967,460 | 7/1976 | Cassity | 166/349 X |
| 4,016,728 | 4/1977 | Mason | 83/390 X |
| 4,095,631 | 6/1978 | Kielb | 144/34 E |
| 4,168,729 | 9/1979 | Tausig et al. | 144/34 E |
| 4,175,598 | 11/1979 | Stoychoff | 144/34 E |

*Primary Examiner*—Stephen J. Novosad

*Attorney, Agent, or Firm*—Roylance, Abrams, Berdo & Goodman

[57] ABSTRACT

An apparatus for remotely cutting a broken guideline extending from an underwater guide post comprising a frame, a clamping mechanism for clamping the frame to the guide post in a predetermined location, a pair of opposed cutting jaws pivotally coupled to the frame, and a remotely actuated power device for pivoting the jaws across the longitudinal axis of the broken guideline to sever the guideline from the guide post. The cutting jaws are pivoted about the same axis and are actuated by a U-shaped driver slidably movable along the frame. The clamping mechanism comprises a pair of opposed jaws receivable in an annular groove in the guide post. Above the cutting jaws are a pair of pivotal loom jaws which guide the assembly on the post and also deflect any interfering portion of the broken guideline extending along the side of the post.

15 Claims, 8 Drawing Sheets

REMOTELY ACTUATED CUTTING ASSEMBLY FOR BROKEN UNDERWATER GUIDELINES

FIELD OF THE INVENTION

The invention relates to an apparatus for cutting a broken guideline extending from an underwater guide post forming part of, for example, a subsea well. The apparatus includes a frame, a clamping mechanism to clamp the frame to the guide post, and a pair of opposed cutting jaws pivotally coupled to the frame. The apparatus is lowered to the guide post via guidelines and a handling string.

BACKGROUND OF THE INVENTION

In the subsea exploration and production of oil and gas, installations are frequently located at the seabed with a plurality of guidelines extending upwardly from guide posts and coupled at sea level to a platform or vessel. These guidelines are used to lower or raise various equipment with connecting devices being coupled to the equipment and being slidable along the guidelines.

Due to the extreme environment of such subsea installations, these guidelines frequently break and must be immediately replaced to continue the subsea operations. To accomplish this replacement, it is advantageous to sever the broken guideline from the guide post from which it extends. In addition, this severance should be as close to the top of the guide post as possible to facilitate replacement.

However, there are two basic problems involved in cutting off the broken remnant of a subsea guideline. The first is the difficulty of remotely guiding a cutter mechanism to the exposed top of the guide post. The other is the difficulty of remotely positioning the guideline itself relative to the cutting mechanism.

In accomplishing this cutting of the broken guideline, the positioning of the cutting device adjacent to the top of the guide post is critical. Thus, it is typically necessary to make the cut as near as possible to the guide post top to minimize the remaining stub of the exposed guideline. This is necessary to facilitate attaching a new guideline with a latch mechanism.

In addition, the breaking of the guideline is random and unpredictable. The break might occur high above the guide post, resulting in a very long, limp pigtail. Often in such cases, the guidelines become crimped near the top of the guide post with a portion of the guideline extending downwardly along the side of the guide post, complicating both the problem of locating the cutting mechanism at the top of the guide post and the problem of positioning the guideline in the cutting mechanism. Alternatively, the break in the guideline may occur within one or two feet above the guide post top. Often in such cases, the guideline will fray into a multi-strand mare's tail, complicating both the problem of locating the cutting mechanism at the top of the post and the problem of positioning the guideline in the cutting mechanism.

While there are various devices for cutting subsea lines, not necessarily broken, and there are various prior art devices for cutting broken guidelines, these have numerous disadvantages. Thus, many of them are quite heavy and bulky, inconvenient to store on a platform or vessel at the sea level, and complicated to manufacture and operate. In addition, many of these devices are not accurately guided to the top of the guide post and do not sever the broken guideline at the required position immediately adjacent the top of the guide post. Finally, these devices do not efficiently handle the various different configurations of the broken guideline.

Examples of these prior art devices are disclosed in the following U.S. Pat. Nos.: 488,837 issued on Dec. 27, 1892 to Squires et al; 504,203 issued on Aug. 29, 1893 to DeBem; 541,018 issued on June 11, 1895 to Shryock; 756,760 issued on Apr. 5, 1904 to Wolf; 1,042,630 issued on Oct. 29, 1912 to Wetmore; 2,175,757 issued on Oct. 10, 1939 to Metzler; 2,825,536 issued on Mar. 4, 1958 to Kenneday et al; 3,036,522 issued on May 29, 1962 to Lindsey; 3,709,291 issued on Jan. 9, 1973 to Hanes et al; and 3,926,252 issued on Dec. 16, 1975 to Ribeyre et al.

Thus, there is still need for improvement in apparatus for and methods of cutting broken subsea guidelines.

SUMMARY OF THE INVENTION

Accordingly, a primary object of the invention is to provide a remotely actuated cutting assembly for broken, underwater guidelines which is accurately guided to the top of a guide post and severs the broken guideline therefrom immediately adjacent the top of the guide post.

Another object of the invention is to provide such a cutting assembly that can accurately sever a broken guideline no matter what configuration the guideline takes.

Another object of the invention is to provide such a cutting assemblv which is light in weight, easy to store and is simple to manufacture and use.

The foregoing objects are basically attained by providing an apparatus for remotely cutting a broken guideline extending from an underwater guide post, the combination comprising a frame; a clamping mechanism, coupled to the frame, for releasably clamping the frame to the guide post in a predetermined location on the guide post; a pair of opposed cutting jaws pivotally coupled to the frame; and a remotely actuated power device, including a member engageable with both of the cutting jaws, for pivoting the cutting jaws across the longitudinal axis of the broken guideline to sever the guideline from the guide post.

Advantageously, the remotely actuated power device comprises a hydraulic power-device with a U-shaped driver coupled to the frame for slidable movement into engagement with the cutting jaws to pivot these jaws into a cutting action. The two cutting jaws pivot about a common axis and resemble a pair of scissors without handles. When lowering the cutting assembly, the cutting jaws are open, thereby presenting a profile allowing easy maneuvering past the broken guideline. As the cutting jaws pivot to the closed position, they embrace and enclose the broken guideline, guiding it to the area on the jaws where actual cutting takes place as the jaws totally close.

The cutting jaws and the clamping mechanism are spaced apart so that the lowermost part of the cutting jaws is immediately adjacent the top of the guide post when the clamping mechanism clamps the frame to the guide post in the predetermined location on the guide post. This is accomplished by having the clamping mechanism releasably received in an annular groove on the outside of the guide post. The clamping mechanism comprises a pair of opposed clamping jaws located below the cutting jaws. These clamping jaws are first engaged with the guide post below the annular groove and then are moved upwardly along the guide post into the groove. A pair of pivotable loom jaws are also provided above the cutting jaws to guide the assembly on the guide post and to push away from the assembly any portion of the guideline extending along the side of the guide post.

Other objects, advantages and salient features of the present invention will become apparent from the following detailed description which, taken in conjunction with the annexed drawings, discloses a preferred embodiment of the invention.

DRAWINGS

Referring now to the drawings which form a part of this original disclosure:

DETAILED DESCRIPTION OF THE INVENTION

Figure 1:
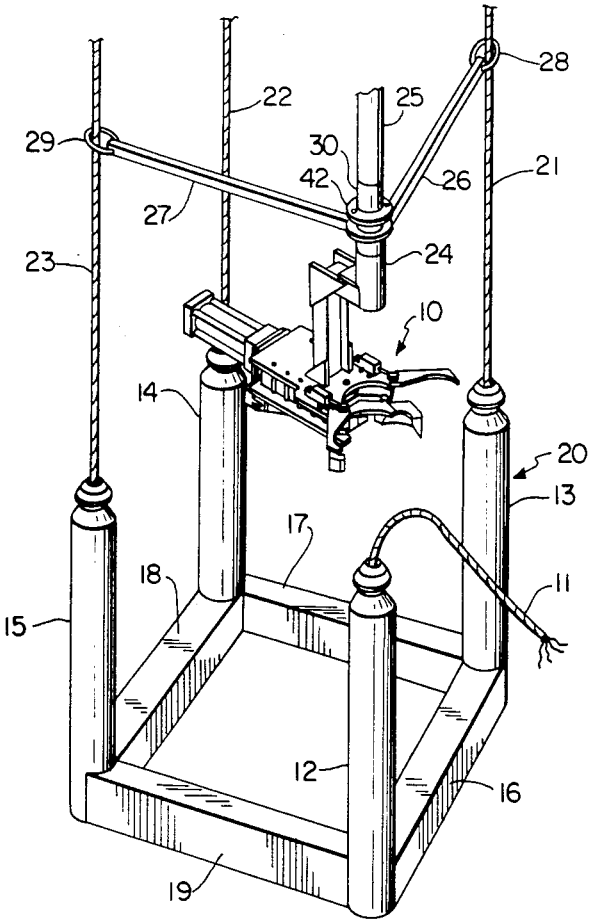
FIG. 1 is a perspective view of the cutting assembly being lowered towards an underwater guide post having a broken guideline extending therefrom.

As seen in FIG. 1, the cutting assembly 10 in accordance with the invention is intended to sever a broken guideline 11 from the upright, underwater guide post 12. This guide post together with three other upright guide posts 13, 14 and 15 are interconnected by four horizontal beams 16–19, which together form an underwater permanent guide base 20 for oil or gas exploration or production. With the guide base 20 located on the seabed, there are three other guidelines 21–23 extending upwardly respectively from guide posts 13–15. These guidelines are connected at their top to a platform or suitable vessel at sea level. In addition to the guide base, guidelines can extend from a blow-out preventer stack and a lower riser package.

To lower and raise the cutting assembly 10 relative to the guide base 20, a cylindrical support 24 is carried by the cutting assembly 10 and is internally threaded to receive external threads on a spindle 30 which is in turn threadedly coupled to a handling string of interconnected pipes 25. To stabilize and guide the cutting assembly 10, the spindle 30 is rotatably received in a spool 42 which carries two horizontal arms 26 and 27. These arms extend outwardly from the spool 90° apart and have shackles 28 and 29 coupled respectively at their ends, these shackles slidably receiving, respectively, guidelines 21 and 23, as seen in FIG. 1.

Figure 2:
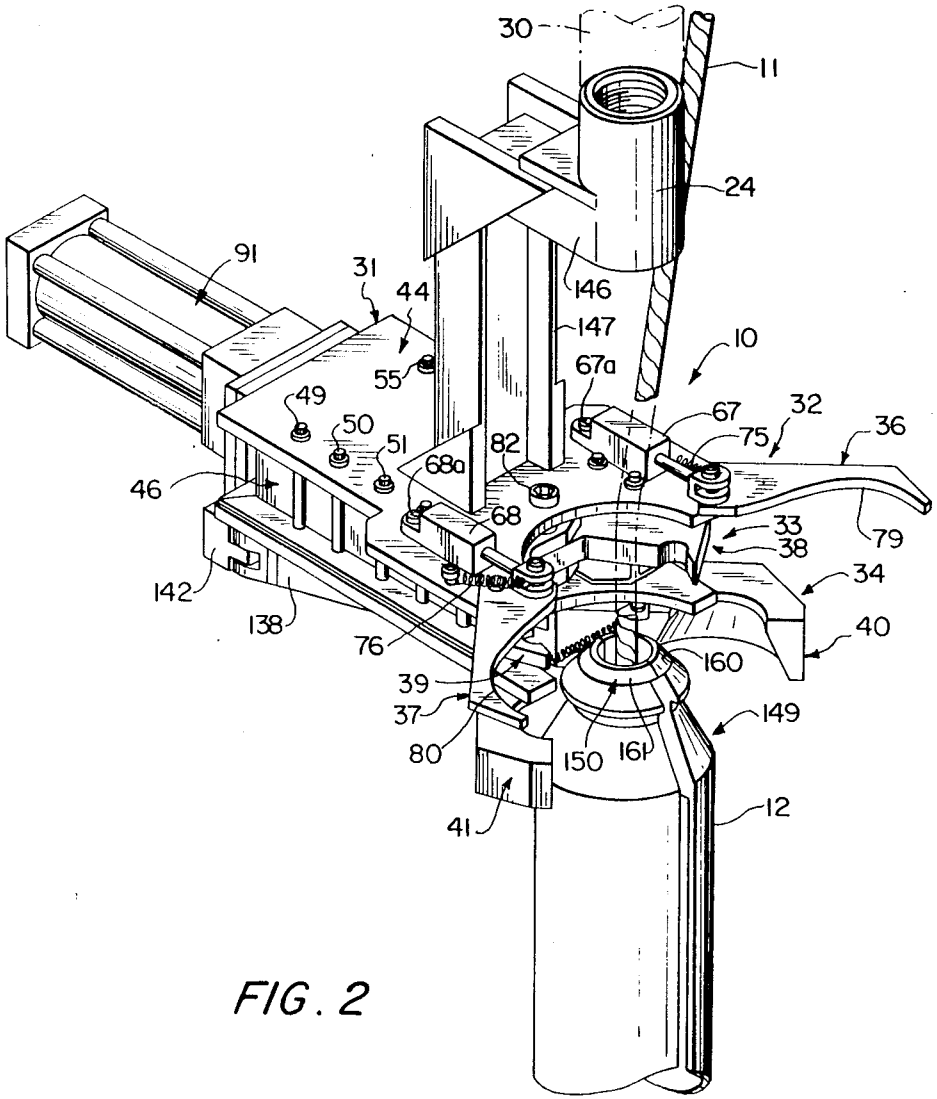
FIG. 2 is an enlarged perspective view of the cutting assembly, guide post and guideline shown in FIG. 1.

Referring now to FIG. 2, the cutting assembly 10 comprises a frame 31, a guiding assembly 32, a cutting jaws assembly 33 and a clamping assembly 34. The guiding assembly 32 includes a pair of opposed guiding or loom jaws 36 and 37; the cutting jaws assembly 33 includes a pair of opposed cutting jaws 38 and 39; and the clamping assembly 34 includes a pair of opposed clamping jaws 40 and 41.

The Frame

Figure 6:
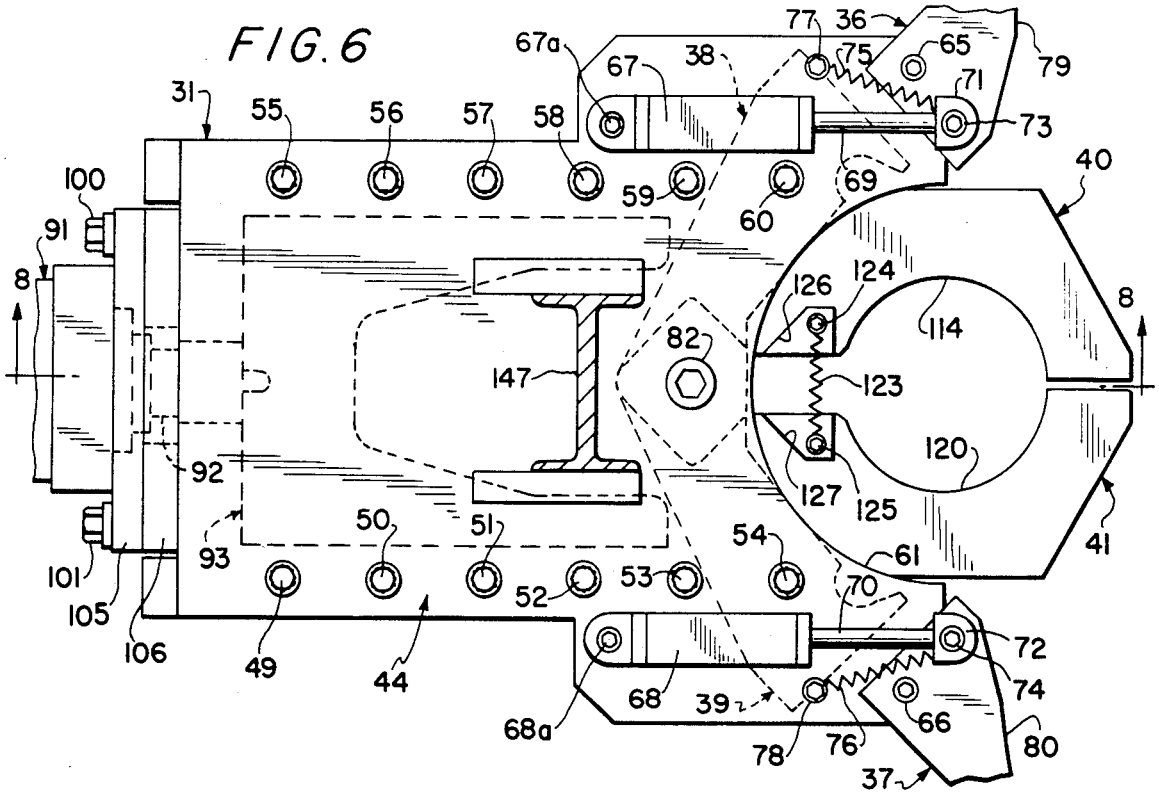
FIG. 6 is a fragmentary top plan view of the cutting assembly with the loom and cutting jaws in the opened position and the clamping jaws in the closed position.
Figure 7:
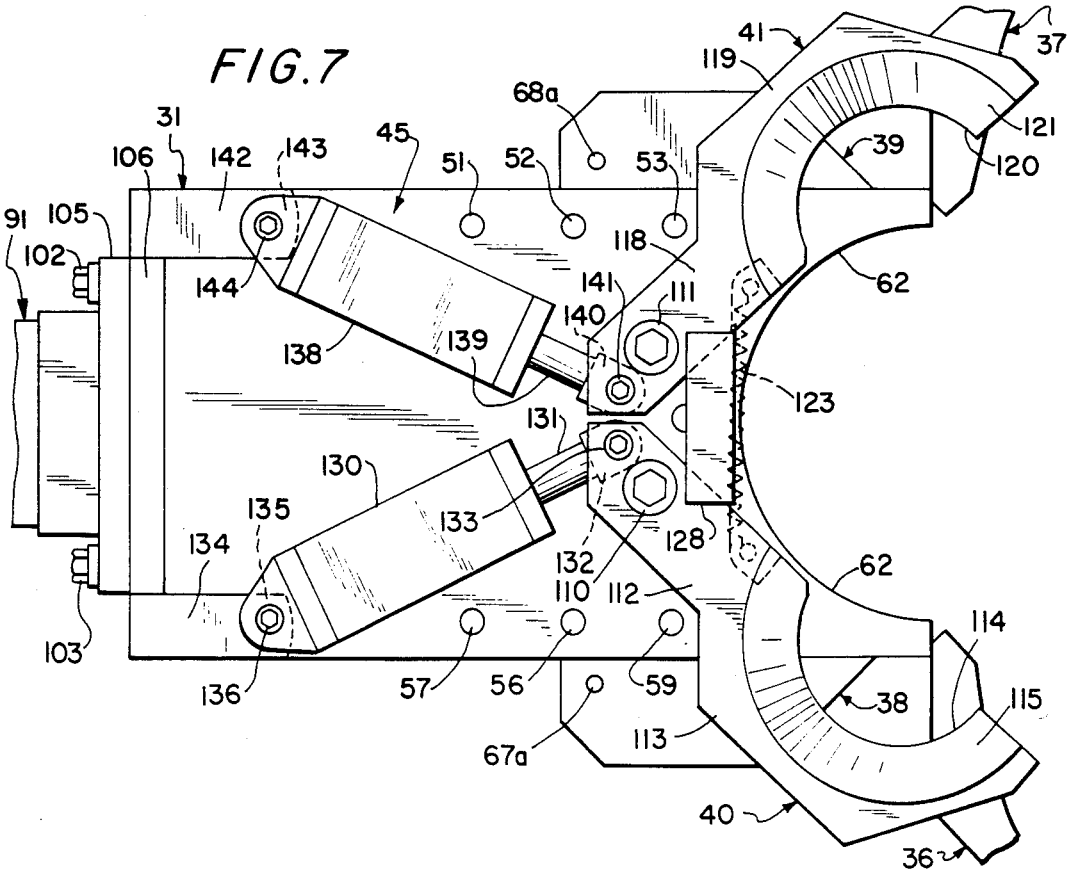
FIG. 7 is a fragmentary bottom plan view of the cutting assembly with all of the jaws in the opened position.
Figure 8:
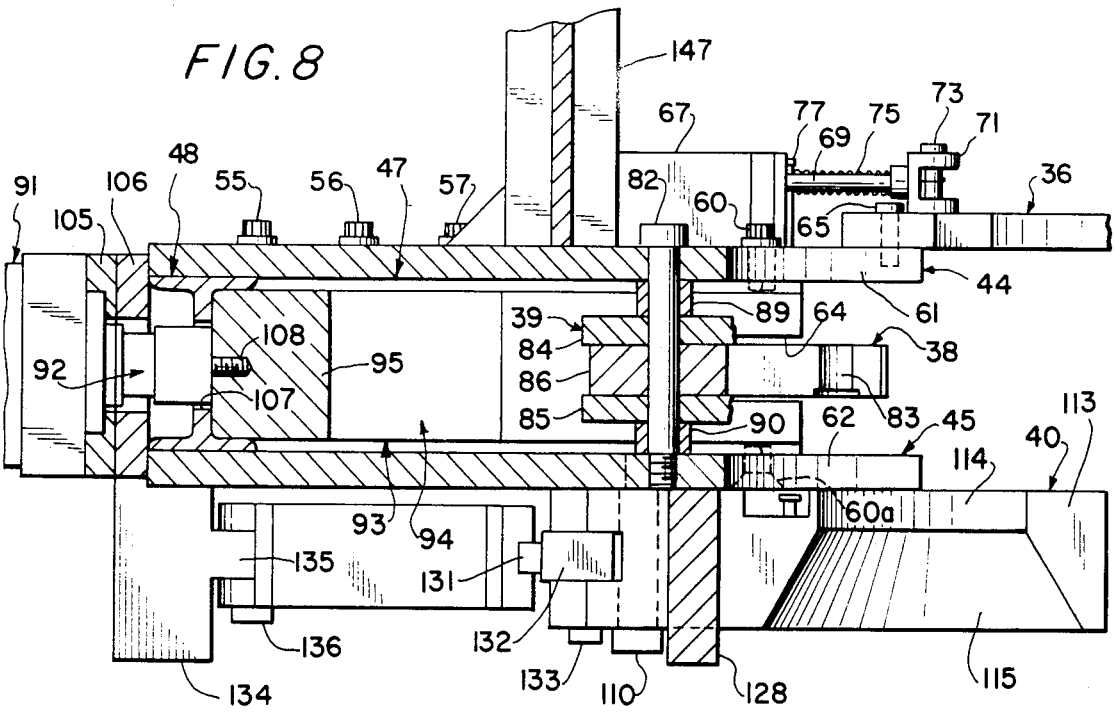
FIG. 8 is a fragmentary side elevational view of the cutting assembly in longitudinal section taken along lines 8—8 in FIG. 6.
Figure 9:
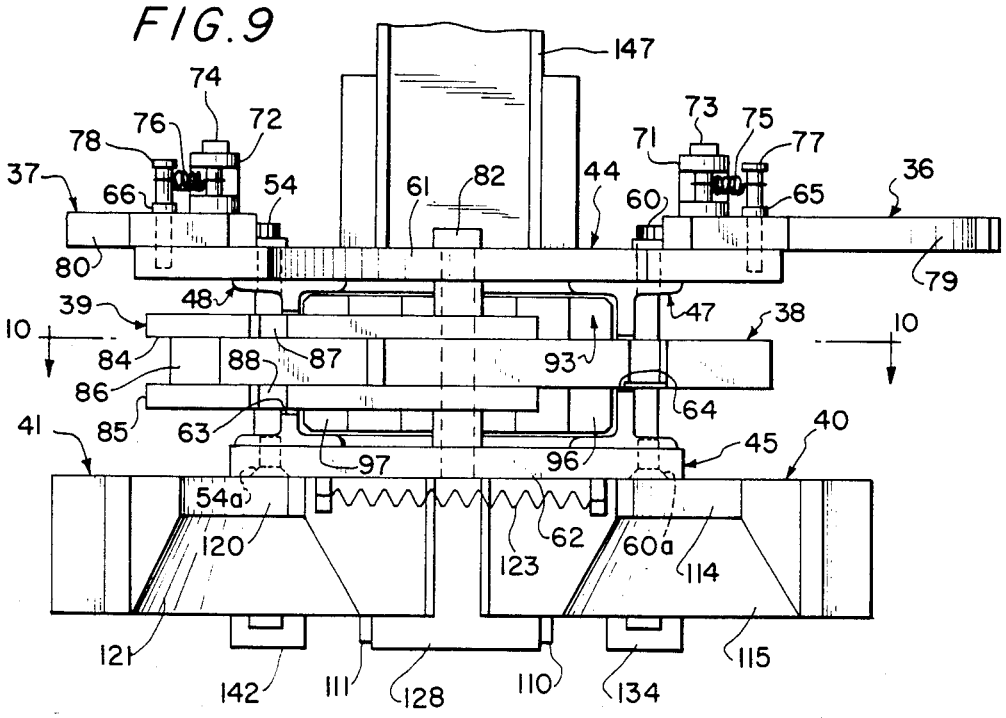
FIG. 9 is a front elevational view of the cutting assembly with all of the jaws in the opened position.

As seen in FIGS. 2, 6, 7, 8 and 9, the frame 31 comprises a top plate 44 and a bottom plate 45 having for example I-beams 46 and 47 interposed therebetween on the left and right sides, as best seen in FIG. 9, and an end I-beam 48 interposed between the plates near the rear end thereof, as best seen in FIG. 8. Thus, I-beams 46 and 47 extend substantially longitudinally of the top and bottom plates 44 and 45, while the end I-beam 48 extends transversely. These plates and the I-beams are coupled together by five bolts 49–53 passing through suitable apertures in these parts on the left hand side and five other bolts 55–59 passing through these parts through suitable apertures on the right hand side, as best seen in FIG. 6. As seen in FIG. 9, two shorter bolts 54 and 60 couple the top plate and I-beams 46 and 47 and two other shorter countersunk bolts 54*a* and 60*a* couple the bottom plate and these two I-beams.

As seen in FIG. 6, the forward end of the top plate 44 has a semi-circular cut-out 61 and as best seen in FIG. 7, the forward end of the bottom plate 45 has a semi-circular cut-out 62 therein.

As best seen in FIGS. 8–11, I-beam 46 has a slot 63 in the forward part to receive cutting jaw 39 when that jaw is open and similarly I-beam 47 has a slot 64 in its forward end to receive cutting jaw 38 when that jaw is open.

The Guiding Assembly

Figure 3:
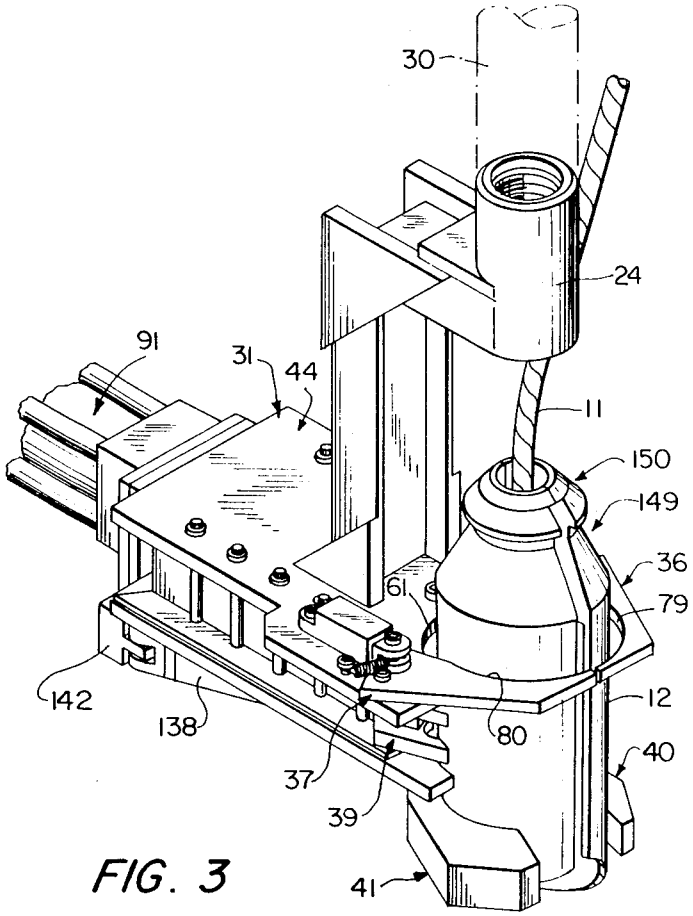
FIG. 3 is a perspective view similar to that shown in FIG. 2 except that the clamping jaws have engaged the guide post and the loom jaws have encircled the guide post.

Referring now to FIGS. 6–9, each of the two loom jaws 36 and 37 in the guiding assembly is pivotally coupled to the front of the top of top plate 44 in the same plane by bolts 65 and 66. To pivot the loom jaws outwardly into the open position, a pair of hydraulic cylinders 67 and 68 are pivotally secured to the top plate 44 via bolts **67*a* and 68*a* and have, respectively, piston shafts 69 and 70 extending therethrough, the free ends of these shafts having, respectively, two clevis 71 and 72 rigidly coupled thereto and pivotally coupled to the loom jaws respectively via bolts 73 and 74. Biasing the loom jaws towards the closed position shown in FIG. 3 are a pair of tension springs 75 and 76 which are coupled rigidly at one end to bolts 73 and 74 rigidly secured to the jaws and at the other end to bolts 77 and 78 rigidly secured to top plate 44. When the hydraulic pressure in cylinders 67 and 68 is relieved, the springs 75 and 76** close the loom jaws.

As seen best in FIGS. 2 and 3, the inside edges 79 and 80 of the two loom jaws 36 and 37 are arcuate so they encircle the cylindrical guide post 12 in the closed position as seen in FIG. 3.

The Cutting Jaws Assembly

Referring now to FIGS. 6, 9, 10 and 11, the cutting jaws 38 and 39 are pivotally coupled between the top and bottom plates along a single bolt 82 passing through suitable apertures in the two jaws and suitable apertures in the top and bottom plates 44 and 45. Jaw 38 is formed from a single member with a semi-circular cut-out 83 near its free end which is bevelled at the bottom to form a cutting edge. Alternately, a replaceable cutting insert can be located in cut-out 83. Jaw 39 is formed of three pieces, either welded together or integrally constructed, including an upper part 84, a lower part 85 and a block 86 rigidly interposed between the upper and lower parts. The upper part 84 has a semi-circular cut-out 87 and the lower part 85 has a semi-circular cut-out 88 near their free ends to coordinate and align with cut-out 83 in jaw 38. As best seen in FIG. 9, the end of jaw 38 which is pivotally coupled to bolt 82 is between the upper and lower parts 84 and 85 of jaw 39, the thickness of block 86 being substantially equal to the thickness of jaw 38. As seen best in FIG. 8, a pair of bushings 89 and 90 are respectively interposed between, on the one hand, the bottom of the top plate and the top of upper part 84 and, on the other, the top of bottom plate 45 and the bottom of lower part 85.

To close the jaws 38 and 39 there is a remotely actuated power device including a hydraulic fluid cylinder 91 rigidly coupled to the frame, a piston shaft 92 coupled to a piston movable relative to and inside of the hydraulic cylinder and a U-shaped driver 93 rigidly coupled to the shaft and slidable within a cavity 94 in the frame defined between the top and bottom plates and the three I-beams. The driver, as seen in FIG. 10, comprises a base 95 and a pair of arms 96 and 97, arm 96 being in a position to contact jaw 38 at its outer tapered edge 98 and arm 97 being in a position to contact jaw 39 at its outer tapered edges 99 upon sliding movement of the driver 93 towards the front of the cutting assembly 10.

The hydraulic cylinder 91 is rigidly secured to the frame 31 via four bolts 100–103 which pass through a plate 105 mounted to the end of hydraulic cylinder 91 and into plate 106, which is rigidly secured, such as by welding, to end I-beam 48 at the rear of the cutting assembly. These plates are suitably apertured, as seen in FIG. 8, to allow piston shaft 92 to travel therethrough, the end I-beam 48 having an aperture 107 therein, as seen in FIG. 8, for passage of the piston shaft 92 therethrough. A threaded end 108 of the piston shaft 92 is received in a suitably internally threaded bore in the base 95 of the driver 93 to rigidly couple these parts together.

Figure 10:
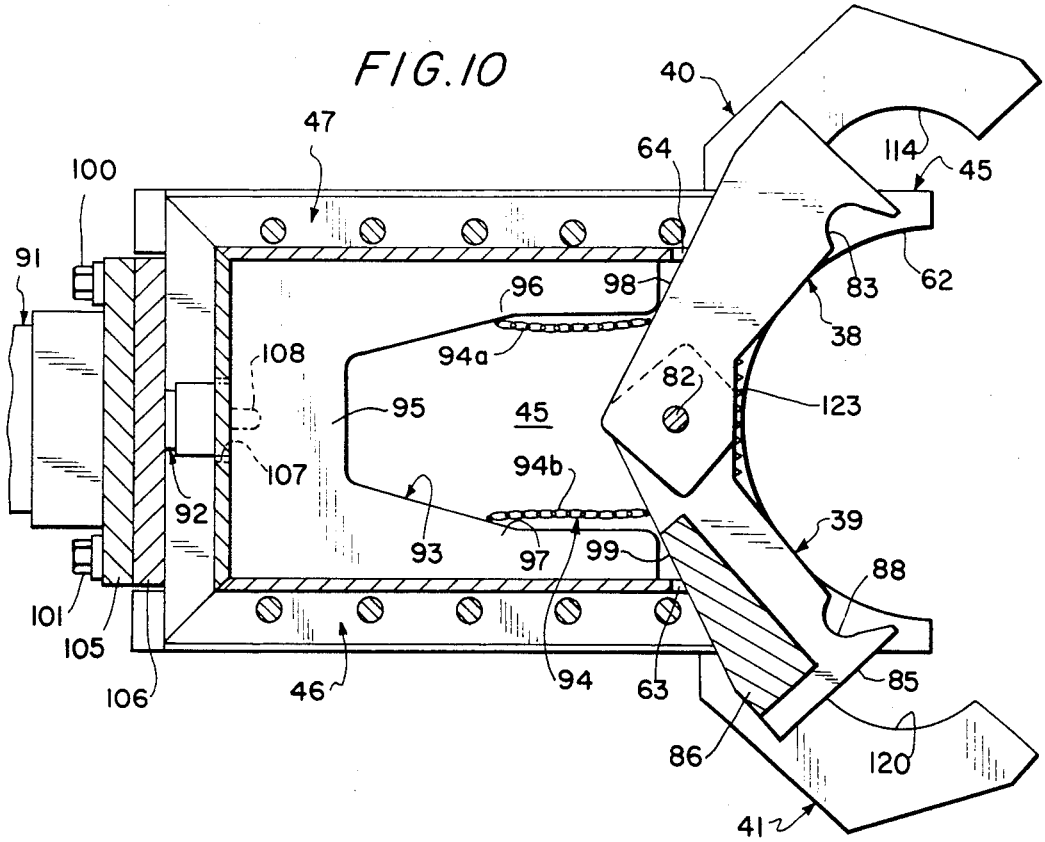
FIG. 10 is a top plan view in section taken along lines 10—10 in FIG. 9 showing the cutting and clamping jaws in the opened position and the driver adjacent the cutting jaws.
Figure 11:
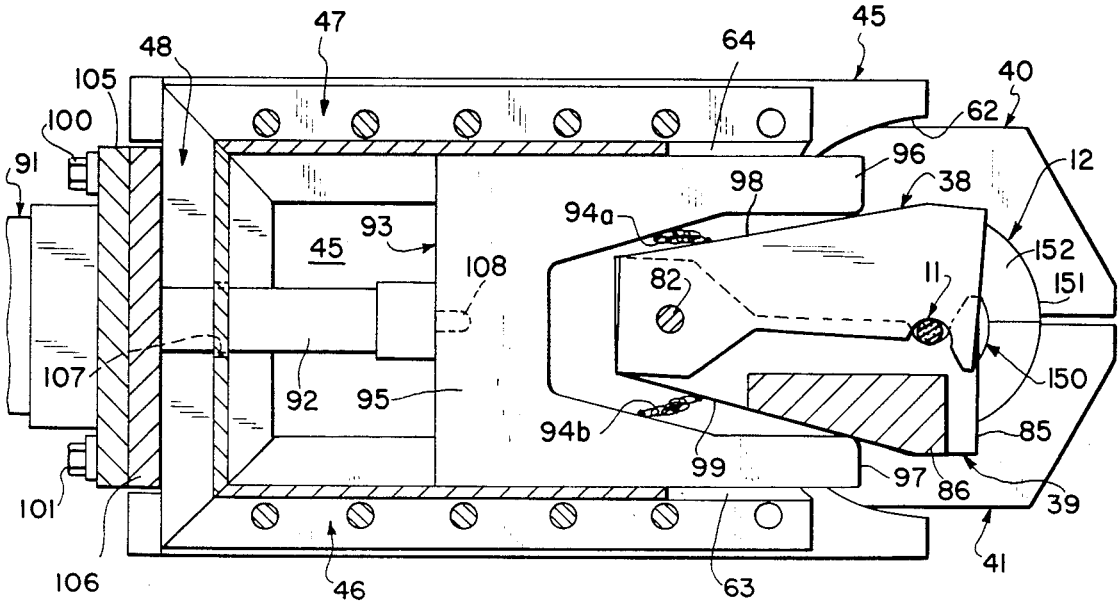
FIG. 11 is a top plan sectional view similar to that shown in FIG. 10 except that the clamping jaws have been closed around the annular groove in the guide post, the driver has been slidably moved into engagement with the cutting jaws and the cutting jaws have been pivoted to sever the broken guideline from the guide post.

As seen in FIGS. 9–11, the driver 93 is received in cavity 94 and rides along the interior sides of the two opposed left side and right side I-beams 46 and 47.

To open the jaws after they have been closed, a pair of light chains **94*a* and 94*b* are tack welded to arms 96 and 97 of the driver and to each of the jaws, as seen in FIGS. 10 and 11**.

The Clamping Assembly

As seen in FIGS. 6–9, the two clamping jaws 40 and 41 are respectively pivotally coupled to the bottom of the bottom plate 45 via bolts 110 and 111 rigidly secured to the bottom plate. Jaw 40 has a base portion 112 receiving the bolt 110 therein via a suitable aperture and a clamping portion 113 having a semi-circular cutout 114, the clamping portion having an upwardly and inwardly tapering frustoconical surface 115 extending downwardly from the cut-out 114. As best seen in FIG. 9, the surface of the cut-out 114 is semi-cylindrical. The other clamping jaw 41 has a similar mirror image base portion 118, clamping portion 119, cut-out 120 and frustoconical surface 121.

As seen best in FIGS. 6 and 7, a tension spring 123 is coupled between bolts 124 and 125 located respectively in recesses 126 and 127 in the two clamping jaws 40 and 41. This tension spring 123 tends to bias the clamping jaws 40 and 41 together into the closed position shown in FIG. 6.

A brace 128 in the form of an inverted T extends rigidly downwardly from the bottom plate 45 between the base portions 112 and 118 of jaws 40 and 41, the outwardly extending arms of the brace extending below each jaw, as seen in FIG. 9.

As best seen in FIGS. 7 and 8, a hydraulic cylinder 130 has a piston shaft 131 extending outwardly therefrom having a bored end 132 pivotally receiving a bolt 133 passing through suitable apertures in jaw 40 to pivotally couple the shaft 131 to jaw 40. At the other end of hydraulic cylinder 130 a block 134 is rigidly secured to the bottom plate 45, this block having a flange 135 suitably bored and receiving a bolt 136 also passing through suitable bores in the end of the hydraulic cylinder 130. Thus, cylinder 130 is pivotally coupled via block 134 to the frame 31.

On the other side of the cutting assembly there is a hydraulic cylinder 138 corresponding to clamping jaw 41 as well as a corresponding piston shaft 139 extending therefrom having a bored end 140 receiving a bolt 141 to pivotally couple jaw 41 to shaft 139. The other end of hydraulic cylinder 138 is similarly pivotally coupled to a block 142 via a bored flange 143 extending from the block and receiving a bolt 144 therein which also passes through suitable bores in cylinder 138. Block 142 is rigidly secured to the bottom plate 145.

Thus, to move the clamping jaws 40 and 41 to their open position as seen in FIG. 7, the piston shafts 131 and 139 are extended towards the front of the cutting assembly 10. To allow the clamping jaws 40 and 41 to close, the hydraulic pressure in the cylinders is relieved and the spring pressure of tension spring 123 brings the clamping jaws into a closed position, such as that seen in FIG. 6. These jaws are locked in the closed position by applying hydraulic pressure to retract shafts 131 and 139 rearwardly of the assembly.

As seen in FIG. 9, brace 128 and blocks 134 and 142 extend in the same plane below the jaws in the cutting assembly. Thus, they can be used as feet to support the cutting assembly on, for example, the vessel at sea level.

Alignment Of The Jaws

Referring again to FIG. 2, the cylindrical support 24 is rigidly coupled to a horizontally oriented support beam 146 which is in turn rigidly coupled to a vertically oriented support beam 147. This beam 147 is in turn rigidly coupled to the top of the top plate 44 of frame 31. As best seen in FIG. 3, the longitudinal axis of the cylindrical support 24 will coincide substantially with the longitudinal axis of the guide post 12 carrying the broken guideline 11 and with the central axis of the circle formed by the two arcuate inner edges 79 and 80 of the loom jaws 36 and 37 taken together with the semi-circular cut-out 61 formed in the top plate 44. In addition, the longitudinal axis of the cylindrical support 24 will coincide substantially with the substantially circular opening formed by the closed cutting jaws, as seen in FIG. 11 defined by the various cut-outs 83, 87 and 88 in the cutting jaws 38 and 39. Finally, this longitudinal axis of the cylindrical support 24 coincides substantially with the central axis of the circle defined by the semi-circular cut-outs 114 and 120 in the two opposed clamping jaws 40 and 41 in the closed position, as seen in FIG. 6.

The Guide Post

Figure 12:
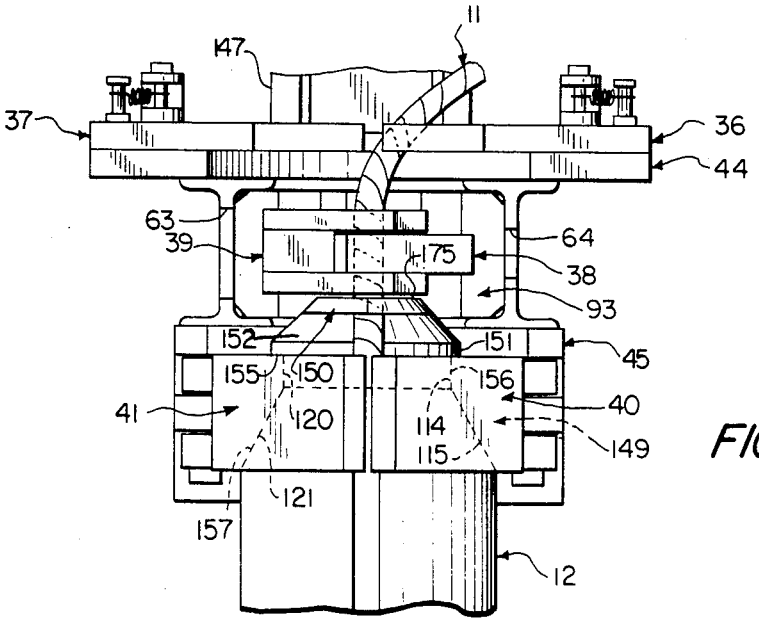
FIG. 12 is a front elevational view of the apparatus shown in FIG. 11.
Figure 15:
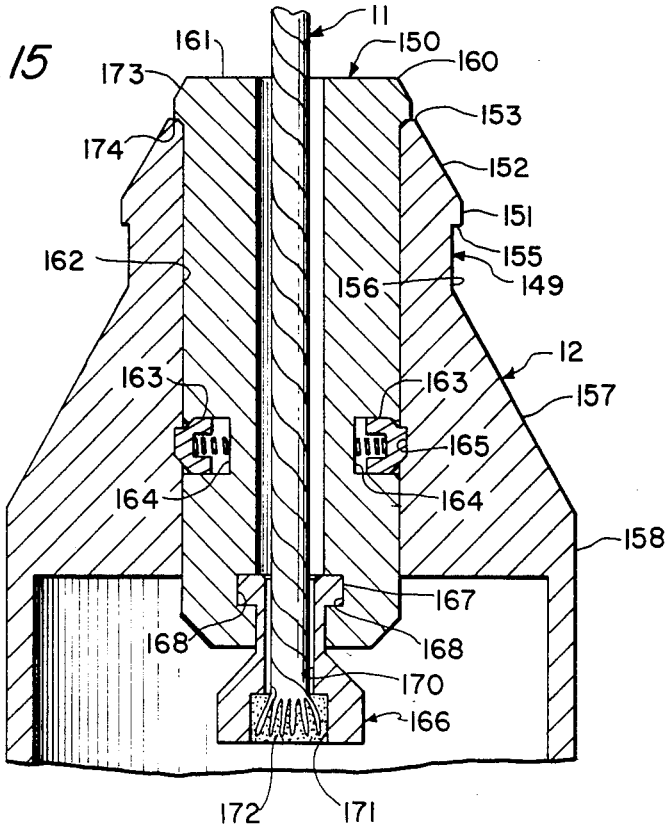
FIG. 15 is a side elevational view in longitudinal section of the guide post with the bushing received therein.

As seen in FIGS. 2, 12 and 15 the guide post 12 has an annular groove 149 formed near the top thereof with a bushing 150 defining the top of the guide post.

The guide post 12 has a cylindrical outer surface 151 extending into an upwardly and inwardly tapered frustoconical surface 152 extending into, at the very top of the guide post, an annular, planar surface 153. The annular groove 149 begins as a downwardly facing annular surface 155 below cylindrical surface 151 and extends into a reduced diameter cylindrical surface 156 which then extends into an inwardly and upwardly tapered frustoconical surface 157, which extends radially to the cylindrical outer surface 158 of the guide post 12. The guideline 11 is coupled rigidly to the guide post and extends upwardly out of the center of the bushing 150.

As seen best in FIG. 2, the bushing 150 is formed of two semi-cylindrical halves 160 and 161. These halves fit into a central bore 162 in the guide post as seen in FIG. 15. Each carries at least one spring biased locking dog 163 in a recess 164 therein for coupling into an internal groove 165 in the guide post. At the bottom of the bushing, a spear 166 is received between and coupled to the two halves. This is accomplished by having an annular flange 167 at the top of the spear received in two opposed internal grooves 168 and 169 in each half. This flange is located in the grooves as the two halves are placed together. The spear has a central bore 170 with an enlarged central cylindrical cavity 171 at the bottom. The guideline 11 passes downwardly between the two halves, through bore 170 in the spear and has a frayed end received in the cavity 171. Molten Babbitt metal 172 is poured into the cavity to secure the frayed end of the guideline to the spear. At the top of the bushing 150 is an upwardly and inwardly tapered frustoconical surface 173 forming a continuation of surface 153 on the guide post and a downwardly facing annular shoulder 174 contacting annular surface 153 on the guide post to support the bushing on the guide post. The bushing has a planar annular surface 175 at the top.

As seen best in FIG. 12, the frustoconical surfaces 115 and 121 on the inside of clamping jaws 40 and 41 have substantially the same taper as the frustoconical surface 157 in annular groove 49 in the guide post 12. Moreover, the vertical height of the cylindrical surface 156 in the annular groove 149 is substantially the same as the vertical height of the semi-cylindrical cut-outs 114 and 120 in clamping jaws 40 and 41. The radius of each cut-out is also substantially equal to the radius of surface 156. Thus, when the jaws are closed as seen in FIG. 12 they will be rigidly received in the annular groove 149.

As also seen in FIG. 12, the cutting jaws 38 and 39 and the clamping jaws 40 and 41 are vertically spaced apart so that the lowermost part of the cutting jaws is immediately adjacent the top of the bushing at annular surface 175 when the clamping jaws are received in the annular groove 149. Thus, the cutting jaws can sever the broken guideline from the guide post 12 immediately adjacent to the top of the bushing. As also seen in FIG. 12, the vertical height between annular surface 175 at the top of the bushing and annular surface 155 at the top of groove 149 is substantially equal to the distance between the bottom of cutting jaw 39 and the tops of clamping jaws 40 and 41.

The Lowering Assembly

Figure 13:
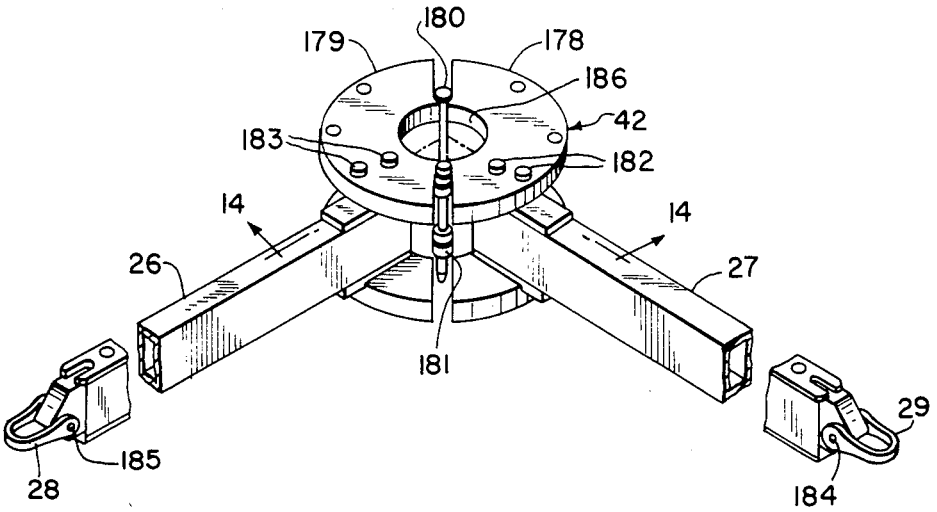
FIG. 13 is a perspective view of the lowering assembly for the cutting assembly including a central spool and a pair of guide arms.
Figure 14:
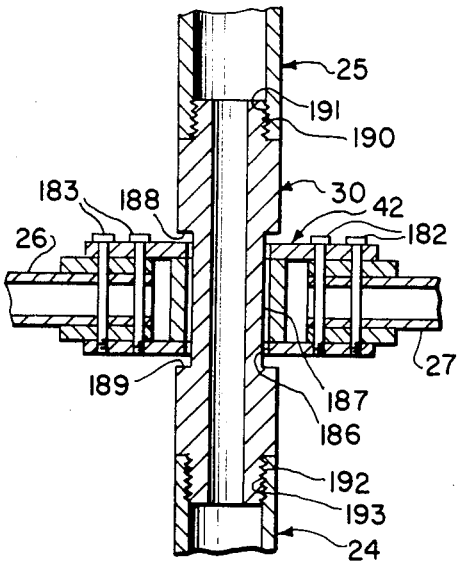
FIG. 14 is a side elevational view in section taken along lines 14—14 in FIG. 13 with the addition of the spindle located in the spool and coupled to the handling string and the cylindrical support.

As seen in FIGS. 1, 13 and 14, the lowering assembly for the cutting assembly 10 comprises the handling string 25, spool 42, arms 26 and 27 having shackles 28 and 29 at their ends, and spindle 30.

The spool is formed as two halves 178 and 179 coupled together by hinges 180 and 181 on opposite sides, hinge 181 being openable to receive the spindle 30 therein. Arms 26 and 27 are rigidly coupled to the spool via pins 182, 182 and 183, 183. Shackles 28 and 29 are releasably coupled to the arms via removable pins 184 and 185 so the guidelines can be inserted into the shackles. Spool 42 has a central bore 186.

Spindle 30 is cylindrical and has a reduced-radius external annular groove 187 which is received in and is smaller than the radius of bore 186 in the spool and is defined by upper and lower annular shoulders 188 and 189. These shoulders extend above and below the spool and past the diameter of bore 186 in the spool to capture the spindle in the spool. This prevents significant relative vertical movement of the spindle and spool but allows relative rotation.

The top of the spindle has threads 190 which threadedly engage threads 191 on the handling tool 25. The bottom of the spindle has threads 192 which threadedly engage threads 193 on the cylindrical support 24 coupled to the frame.

Thus, by rotating the handling string 25, the cutting assembly 10 can be rotated, via the spindle connection with the handling string, to any desired angular position relative to guide post 12.

Operation

To begin the operation of cutting the broken guideline 11, the cutting assembly 10 is first lowered from the sea level through the water by lowering the handling string 25 coupled thereto with shackles 28 and 29 being slidably received around the unbroken guidelines 21 and 23. This lowering proceeds from the position seen in FIG. 1 to that seen in FIG. 2 as the cutting assembly approaches the guide post 12. In this lowering sequence, the loom jaws 36 and 7, the cutting jaws 38 and 39 and the clamping jaws 40 and 41 are open as seen in FIGS. 2 and 7 so the assembly can easily be maneuvered past the broken guideline, be it in a mare's tail or pigtail configuration. By using television monitors, the cutting assembly is advantageously rotated to a position relative to the guide post so that its frame is on the side of the guide post opposite the trailing end, if any, of the broken guideline. This avoids having to cut a double thickness of the guideline.

As the clamping jaws 40 and 41 move below the annular groove 149 in the guide post 12, the hydraulic pressure in cylinders 130 and 138 maintaining these jaws open is relieved so that tension spring 123 tends to close the clamping jaws. This is shown in FIG. 3 with the clamping jaws being in contact with the outer cylindrical surface of the guide post 12. In addition, the hydraulic pressure in hydraulic cylinders 67 and 68 corresponding to the loom jaws 36 and 37 is relieved so that tension springs 75 and 76 close the loom jaws as seen in FIG. 3 around the guide post. This is best accomplished when the loom jaws are below the bushing so that when they close they engage the guide post only and do not also engage a portion of the broken guideline that may be extending along the side of the post.

Figure 4:
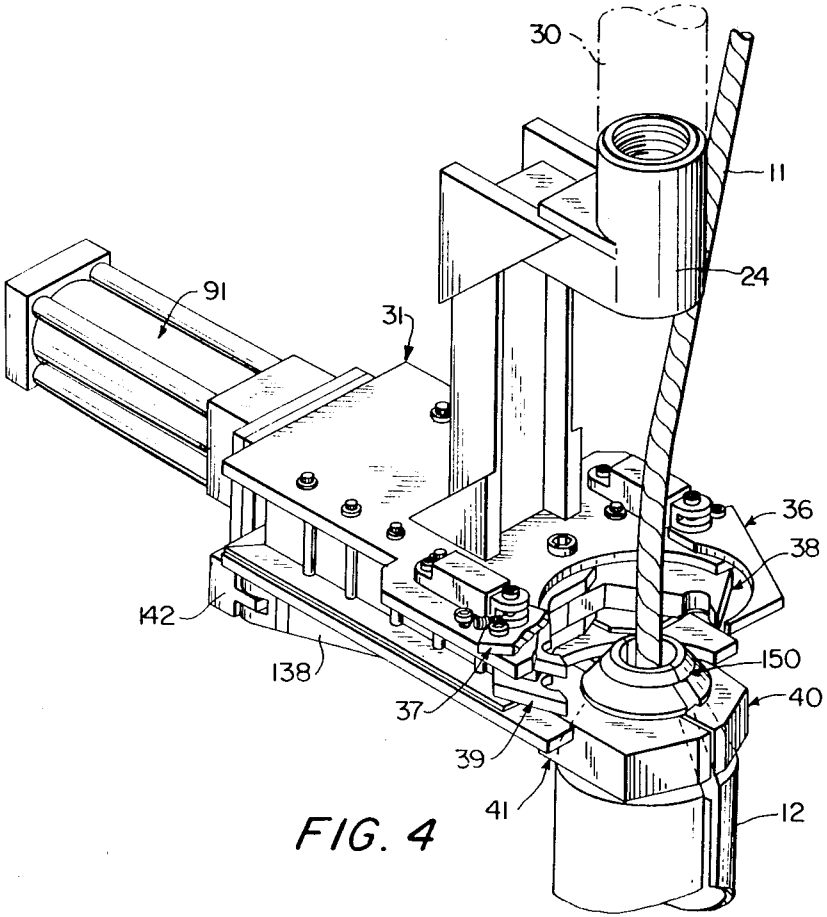
FIG. 4 is a perspective view similar to that shown in FIG. 3 except that the cutting assembly has been raised upwardly so that the clamping jaws are received in an annular groove on the guide post and the cutting jaws are at a position to sever the guideline immediately adjacent the top of the guide post.

Then, the cutting assembly 10 is slowly raised upwardly with the clamping jaws 40 and 41 sliding along and engaging the guide post 12 and with the loom jaws moving along the post and pushing away any interfering portions of the broken guideline. This upward movement continues until the clamping jaws are fully received in the annular groove 149 below bushing 150 as seen in FIGS. 4 and 12. The reception of the clamping jaws in this groove prevents further upward movement. The clamping jaws are then locked in the closed position by hydraulic pressure, thereby preventing downward movement.

Figure 5:
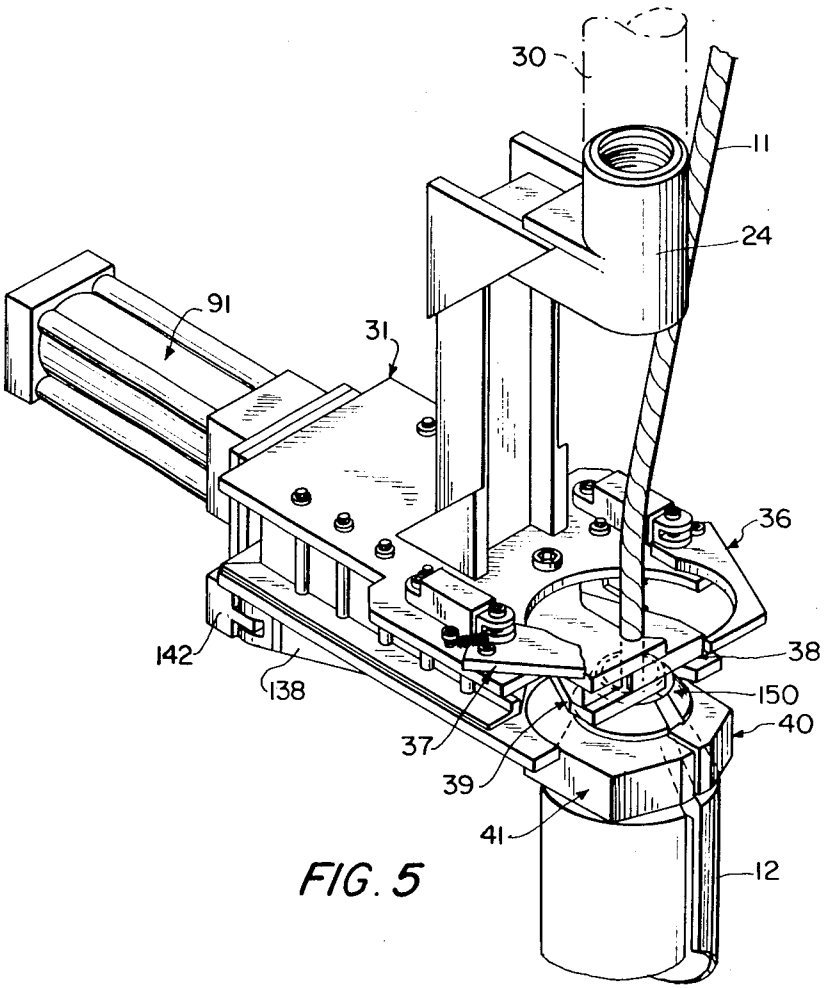
FIG. 5 is a perspective view similar to that shown in FIG. 4 except that the cutting jaws have been actuated to pivot across the longitudinal axis of the broken guideline.

At this time, hydraulic cylinder 91 is activated to drive piston shaft 92 towards the guide post 12. This results in slidable movement of the driver 93 from the position shown in FIG. 10 into engagement with the tapered outer edges of the cutting jaws 38 and 39. This engagement causes the cutting jaws to pivot around their common pivot bolt 82 and sweep the broken guideline 11 therebetween and into the cut-outs 83, 87 and 88 in these jaws. The location of the broken guideline 11 in these cut-outs is seen in FIGS. 5, 11, and 12. Continued pivotal movement of these jaws in a scissoring motion to the fully closed position severs the broken guideline 11 immediately adjacent the top annular surface 175 of bushing 150, as best seen in FIG. 12. As seen in FIG. 11, the driver 93, which powers the closing of the cutting jaws, provides a large mechanical advantage allowing use of a minimum amount of structural materials and small capacity power components. Thus, as the driver advances, the cutting jaws pivot towards each other and towards a common centerline. The angle between the outer edges of the jaws and this common centerline (which is also the centerline of the driver and its motivating piston shaft 92) steadily decreases, which means that the applied force to the guideline steadily and dramatically increases. This results in a favorable wedge effect powering the jaws closed and severing the trapped guideline.

In addition, since the cutting jaws approach the top of the guide post from below, the interference posed by the guideline is minimized. Moreover, by initially gripping the guide post, which itself carries the broken guideline, by means of the clamping jaws, problems of guiding the guideline into the cutting jaws are minimized.

If for some reason, the guideline is not cut on the first attempt, the driver 93 is moved back to the retracted position shown in FIG. 10 under the influence of hydraulic cylinder 91 and thereby pulls the cutting jaws open again via chains 94*a* and 94*b* for another severing action.

After the guideline is severed, the clamping jaws 40 and 41 are moved to their open position by activation of hydraulic cylinders 130 and 138 and the entire cutting assembly 10 is moved upwardly through the water to the surface by upward movement of handling string 25. Then, a new guideline can be reinstalled on guide post 12 with a very small stub of broken guideline extending above the top of the guide post.

Figure 16:
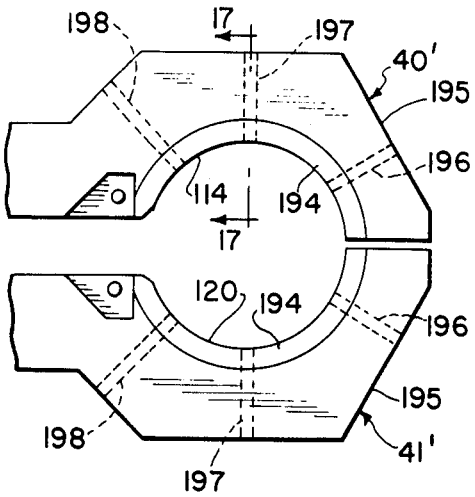
FIG. 16 is a top fragmentary view of two modified clamping jaws having shearable removable inner portions.
Figure 17:
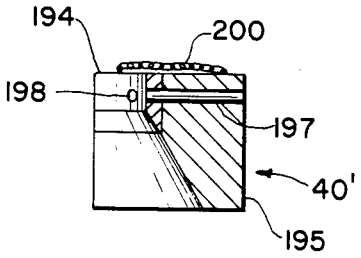
FIG. 17 is a side elevational view in section taken along lines 17—17 in FIG. 16 of one of the jaws.
Figure 18:
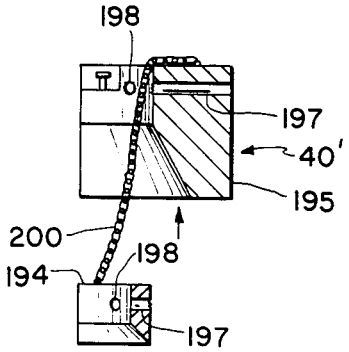
FIG. 18 is a side elevational view similar to that shown in FIG. 17 except that the inner portion of the jaw has been released, by severance of shear pins, from the outer portion due to upward movement of the outer portion.

The Modified Clamping Jaws Of FIGS. 16-18

As seen in FIGS. 16–18, the clamping jaws 40′ and 41′ are modified from those shown in FIGS. 1–12 to include inner portions 194 and outer portions 195 which are releasably coupled by three shear pins 196, 197 and 198 received in suitable horizontal aligned bores in these portions.

This releasable connection is provided to protect the cutting assembly and the guide post in case of an abrupt, violent upward movement of the handling string 25 while the clamping jaws are engaged with the guide post. This movement can be caused by violent wave activity, for example.

In such a case, the handling string will move upward and carry the cutting assembly with it, including the outer portions of the clamping jaws which are severed from the inner portions received in groove 149 in the post. This movement and severance is shown when comparing FIGS. 17 and 18. Advantageously, the inner portions can be loosely chained by chain 200 to the outer portions so they will not be lost upon severance of the shear pins.

The inner portions 194 extend radially outward from the semi-circular cut-outs 114 and 120 in the clamping jaws and are formed as ring segments with frustoconical surfaces at the bottom on the inside as seen in FIG. 18.

The shear value of the pins is at a high value which is slightly less than the yield point for release of the inverted T brace 128 coupled to the bottom of the bottom plate 45 and supporting the clamping jaws as seen in FIG. 9.

While one advantageous embodiment has been chosen to illustrate the invention, it will be understood by those skilled in the art that various changes and modifications can be made therein without departing from the scope of the invention as defined in the appended claims. For example, hydraulic cylinder 91 could be vertically mounted on the frame and move the driver horizontally by means of a pair of links pivotally coupled to the frame, to the piston shaft and to the driver.

What is claimed is:

1. An apparatus for remotely cutting a broken guideline extending from an underwater guide post, the combination comprising:

a frame;

clamping means, coupled to said frame, for releasably clamping said frame to the guide post in a predetermined location on the guide post;

a pair of opposed cutting jaws pivotally coupled to said frame above said clamping means; and remotely actuated power means, coupled to said frame and including a member engageable with both of said cutting jaws, for pivoting said cutting jaws across the longitudinal axis of the broken guideline to sever the guideline from the guide post, said cutting jaws and said clamping means being spaced apart by a fixed distance so that the lowermost part of said cutting jaws is immediately adjacent the top of the guide post when said clamping means clamps said frame to the guide post in said predetermined location on the guide post.

2. An apparatus according to claim 1, wherein said member comprises a driver means coupled to said frame for slidable movement into engagement with said cutting jaws to pivot said cutting jaws.

3. An apparatus according to claim 2, wherein said driver means comprises a substantially U-shaped member.

4. An apparatus according to claim 3, wherein said U-shaped member has two arms, each engageable with one of said opposed cutting jaws.

5. An apparatus according to claim 1, wherein said opposed cutting jaws are pivotally coupled to said frame along a common axis.

6. An apparatus according to claim 1, wherein said remotely actuated power means comprises a hydraulic power device.

7. An apparatus according to claim 6, wherein said hydraulic power device comprises a hydraulic fluid housing coupled to said frame, a hydraulic piston received in said housing, and a hydraulic piston shaft coupled to said piston and to said driver means.

8. An apparatus according to claim 1, wherein said clamping means comprises two opposed clamping jaws pivotally coupled to said frame.

9. An apparatus according to claim 8, wherein said clamping means comprises hydraulic power means for opening said clamping jaws and spring means for closing said clamping jaws.

10. An apparatus according to claim 1, and further comprising guiding means, coupled to said frame, for guiding said frame along the guide post.

11. An apparatus according to claim 10, wherein said guiding means comprises a pair of opposed guiding jaws pivotally coupled to said frame.

12. An apparatus according to claim 11, wherein said guiding means further comprises hydraulic power means for pivoting said guiding jaws open and spring means for pivoting said guiding jaws closed.

13. An apparatus according to claim 10, wherein said guiding means is located above said cutting jaws.

14. An apparatus according to claim 1, wherein said clamping means comprises an inner portion for engaging the guide post and an outer portion, said inner and outer portions being releasably coupled together.

15. An apparatus for remotely cutting a broken guideline extending from an underwater guide post, the combination comprising:

a frame;

clamping means, coupled to said frame, for releasably clamping said frame to the guide post in a predetermined location on the guide post;

a pair of opposed cutting jaws pivotally coupled to said frame; and remotely actuated power means, coupled to said frame and including a member engageable with both of said cutting jaws, for pivoting said cutting jaws across the longitudinal axis of the broken guideline to sever the guideline from the guide post, said clamping means being coupled to said frame below said opposed cutting jaws, and said cutting jaws and said clamping means being spaced apart by a fixed distance so that the lowermost part of said cutting jaws is immediately adjacent the top of the guide post when said clamping means clamps said frame to the guide post in said predetermined location on the guide post, said member comprising a substantially U-shaped unitary driver means coupled to said frame for slidable movement into engagement with said cutting jaws to pivot said cutting jaws, said U-shaped driver means having two arms, each engageable with one of said opposed cutting jaws, said clamping means comprising two opposed clamping jaws pivotally coupled to said frame.

* * * * *